US009956808B2

(12) United States Patent
Zhong

(10) Patent No.: US 9,956,808 B2
(45) Date of Patent: May 1, 2018

(54) AUTOMATIC CIRCULATION BINDER

(71) Applicant: Jiagui Zhong, Guangdong (CN)

(72) Inventor: Jiagui Zhong, Guangdong (CN)

( * ) Notice: Subject to any disclaimer, the term of this patent is extended or adjusted under 35 U.S.C. 154(b) by 0 days. days.

(21) Appl. No.: 15/117,724

(22) PCT Filed: May 6, 2014

(86) PCT No.: PCT/CN2014/076845
§ 371 (c)(1),
(2) Date: Aug. 9, 2016

(87) PCT Pub. No.: WO2015/161529
PCT Pub. Date: Oct. 29, 2015

(65) Prior Publication Data

US 2017/0008329 A1 Jan. 12, 2017

(30) Foreign Application Priority Data

Apr. 25, 2014 (CN) ..... 2014 2 0208154 U

(51) Int. Cl.
*B42F 13/16* (2006.01)
*B42F 13/20* (2006.01)
(Continued)

(52) U.S. Cl.
CPC ..... *B42F 3/04* (2013.01); *B42F 11/00* (2013.01); *B42F 13/16* (2013.01); *B42F 13/20* (2013.01); *B42F 13/22* (2013.01); *B42F 13/26* (2013.01)

(58) Field of Classification Search
CPC ..... B42F 13/16; B42F 13/20; B42F 13/22; B42F 13/26
(Continued)

(56) References Cited

U.S. PATENT DOCUMENTS 2,236,321 A * 3/1941 Ostrander ..... B42F 13/28 402/33
3,954,343 A * 5/1976 Thomsen ..... B42F 13/26 402/20

(Continued)

*Primary Examiner* — Kyle Grabowski

(57) ABSTRACT

Disclosed is an automatic circulation binder, comprising a housing (1), a pair of pivotable hinged plates (2) which are located in the housing (1) and are tightly clamped by the housing (1), and multiple pairs of half ring elements (3) respectively fixed on the pair of hinged plates (2), wherein the half ring element (3) extends out of an upper surface of the housing (1); the automatic circulation binder also comprises a push rod (4) which is located in the housing (1) and capable of moving in an axial direction of the housing, the push rod (4) is located below the hinged plates (2), and a first through groove (5) and a second through groove (6) are successively provided on the push rod (4) from the left to the right in the axial direction of the housing, wherein an automatic rotation push rod locating sleeve (7) is provided in the first through groove (5) and an upper end of the automatic rotation push rod locating sleeve (7) is fixedly connected to an inner surface of the housing (1), a return spring (8) is provided in the second through groove (6), and the return spring (8) is connected to the hinged plates (2); and a plurality of ejection strips (9) are provided on the upper end of the push rod (4), through grooves (10) are correspondingly provided on the hinged plates (2) such that the ejection strips (9) penetrate through the through grooves (10), and snap grooves (11) matched with the front end of the ejection strips (9) are also located on the inner surface of the housing (1). The automatic circulation binder has a simple structure, and a circulating process of opening and closing can be completed by means of circular pushing with one hand, and the operation is comfortable, easy, and convenient, the usage costs are reduced, and the market demands are met.

9 Claims, 4 Drawing Sheets

(51) Int. Cl.

| | |
|---|---|
| ***B42F 13/22*** | (2006.01) |
| ***B42F 13/26*** | (2006.01) |
| ***B42F 3/04*** | (2006.01) |
| ***B42F 11/00*** | (2006.01) |

(58) Field of Classification Search
USPC ..... 412/29–31, 36–38, 41
See application file for complete search history.

(56) References Cited

U.S. PATENT DOCUMENTS

| | | | | | |
|---|---|---|---|---|---|
| 4,130,368 | A * | 12/1978 | Jacoby | B42F 13/22 | 402/20 |
| 4,566,817 | A * | 1/1986 | Barrett, Jr. | B42F 13/22 | 402/33 |
| 9,102,187 | B1 * | 8/2015 | Zhong | B42F 13/22 | |
| 9,333,794 | B2 * | 5/2016 | Zhong | B42F 13/22 | |
| 2005/0207826 | A1 * | 9/2005 | Cheng | B42F 13/26 | 402/31 |
| 2007/0140780 | A1 * | 6/2007 | Petrie | B42F 13/26 | 402/41 |
| 2012/0121317 | A1 * | 5/2012 | Warmus | B42F 13/26 | 402/31 |
| 2014/0140754 | A1 * | 5/2014 | Whaley | B42F 13/36 | 402/41 |

* cited by examiner

AUTOMATIC CIRCULATION BINDER

BACKGROUND OF THE INVENTION

The invention relates to a stationery accessory, specifically relates to an automatic loop folder for fixing the paper sheets.

Hole folder belongs to a stationery accessory, generally the trade calls it a binder or a ring folder. Document safekeeping with the folder is safe and secure, pages turn smoothly, it will not scratch the document paper sheet, hook tips are engaged without opening, it is elegant in appearance solid in structure, not prone to scratch or depression, the whole folder strength is improved, and not easy to deform. Generally the folder comprises a rectangular shell, a pair of pivotable hinged plates located in and clamped by the shell and half-ring elements fixed on the hinged plates, those half-ring elements can close or open together with pivotable movement of the hinged plates, when in a closed mode, the two half-ring elements on the corresponding positions of the hinged plates abut together to form a complete ring shackle for fixing and turn the paper, when in an open mode, the ends of the two half-ring elements part from each other to create an opening, so it can remove or add paper sheet through the opening. Currently closing and opening of the folder on the market are controlled with both hands to push aside the two half-ring elements of the hinged plates, this needs a certain force of the hands, and it has to be operated simultaneously with both hands, hand feeling is not good, and the intensity is not uniform, it is easy to damage the folder to increase the costs, when the number of paper sheets in the half-ring elements become relatively more, it is inconvenient to open or close the folder with both hands.

BRIEF SUMMARY OF THE INVENTION

The invention is intended to effectively overcome the deficiencies of these technologies, provide an automatic loop folder that is simple in structure and can be completely opened and closed with one hand, and it is comfortable, easy, simple and convenient in operation, and reduces the costs.

The invention technical solution is achieved in such a manner: it comprises a shell, a pair of pivotable hinge plates located in and clamped by the shell and several pairs of the half-ring elements fixed on the hinged plates, the said half-ring elements protrude from out of the shell surface, the improvement comprises: it further comprises a push rod located inside the shell and moves along the axial direction of the shell, on the push rod from left to right are the 1st continuous slot and the 2nd continuous slot in sequence along the axial direction of the shell, the said 1st slot is provided with a positioning sleeve of the automatic rotating push rod, upper end of the positioning sleeve of the said automatic rotating push rod is fixed on the inner surface of the shell, the said 2nd slot is equipped with one recoil spring connected with the hinged plates, upper end of the push rod is provided with several mandrils, there are continuous slots at the corresponding positions of the hinged plates, the said mandrils pass through the said continuous slots, and there is a neck on the inner surface of the shell, which matches with the front end of the mandril.

In the structure above, the positioning sleeve of the said automatic rotating push rod comprises a connecting rod cap bushed on the connecting rod, supporting drivepipe, compression spring in the supporting drivepipe, turnplate sleeve and slide pawl sleeve, the left end of the said connecting rod is connected to the left end of the 1st continuous slot, the right end of the connecting rod is connected to the right end of the 1st continuous slot, the upper end of the supporting drivepipe is fixed on the inner surface of the shell, left end of the supporting drivepipe is connected to the cap, there are three embossments on the inner surface of the right end of the supporting drivepipe, which are in parallel with the supporting drivepipe and uniformly distributed, right end of the turnplate sleeve protrudes into the slide pawl sleeve, right end of the slide pawl sleeve is close to the right end of the 1st continuous slot, left end of the turnplate and left end of the slide pawl sleeve are respectively provided with turnplates and slide pawls, there are grooves corresponding to the said embossments on outer circumferential surfaces of the turnplate and slide pawl, turnplate sleeve and slide pawl sleeve can move inside the supporting drivepipe along the embossments via the groove, slide pawl sleeve can drive the turnplate sleeve to move and rotate, the said connecting rod is also provided with a connection block that is near the left end of the turnplate, and one end of the said compression spring is connected with the cap while the other end is connected with the connection block.

Above-mentioned the Construction, the groove outer peripherally divided the described dial surface into three same size wheel lugs, in the right end of wheel lug has a sloping surface and inclined face (tilting in the same direction), vertical face. Described grooves divided the claw external circular surface into three same size slip claw convex block in turn. Among of them, each pair of sliding claw convex blocks include separate first bump and second convex block, which are same size and setup side by side, all has the first inclined plane and a second inclined plane at the left end. Described the rake face should be relatively to the inclined cambered surface stated, and the second inclined plane be correspond to the inclined face. When the first rake face of the first block push against the inclined cambered surface and the second inclined surface of the convex against the inclined face. The turntable jacket rotate, and the first bump into the groove of the turnplate, the left of embossment contacted with the inclined face.

The Construction described above, with AIO open clamp helical surface, close clamp cartridge surface, and the clip helicoid which matches the mentioned card slot on the front end.

The given out the Construction aforesaid, the left and right sides on top of support sleeve respectively equipped with cassette, and the central section with card column, inside the shell surface respectively with corresponding cassette stuck, card column and snaps connected to connecting base and jointed column.

The above the Construction mentioned, the right end is equipped with handle, which is in right end of the described shell.

In the above mentioned the Construction, the right end face of shell extended upward a dam-board, which owns handle grooves corresponding to the described damper.

Within the aforesaid the Construction, the right end of block shot stretched into the stated support casing, the right end face of caps uniformly equipped with three links. The corresponding location on support sleeve has peg hole (with hook clasps inside) linked to described hanger.

In the aforementioned the Construction, each multiple-pair half ring components in half ring components are composed of circular bracelet and oblique bracelet, which can mesh with each other.

This invention beneficial effects are: the Automatic cycle clip provided, is simple construction, through the positioning lock, driving spring and the top bar, set on the automatically rotated positioning sleeve of push rod, driven the push rod cyclical with single hand, might complete the circular opening and closing process of open clip and closed clip, for comfortable and convenient operation, cost reduction, as well as satisfy the market demand.

100. linkage; 101. block shot; 102. support sleeve; 103. compression spring; 104. swivel plate sleeve; 105. sliding claw sleeve; 106. convex column; 107. swivel plate; 108. slide claw; 109. groove; 110. link block;

200. convex block of swivel plate; 201. tilted camber surface; 202. vertical surface; 203. tilted face;

300. the first bump; 301. the second convex block; 302. the first inclined plane; 303. the second dip plane;

400. open clamp screw surface; 401. clip the cartridge surface; 402. the clip helical surface;

500. clamping deck; 501. clamping column;

600. Hanger; 601. Peg hole;

700. round looped link; 701. inclined looped link.

DETAILED DESCRIPTION OF THE INVENTION

Invention combined with the appended drawings below and implement case is for further description.

Figure 1:
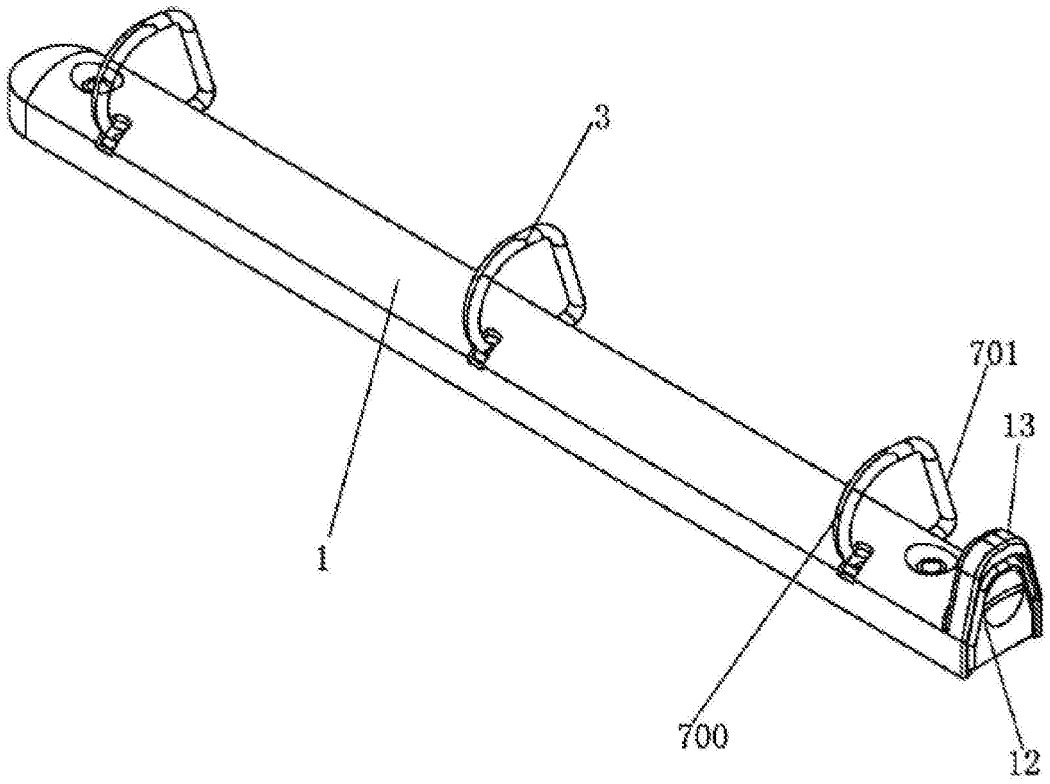
FIG. 1 This 3D invention of the Automatic cycle clip
Figure 2:
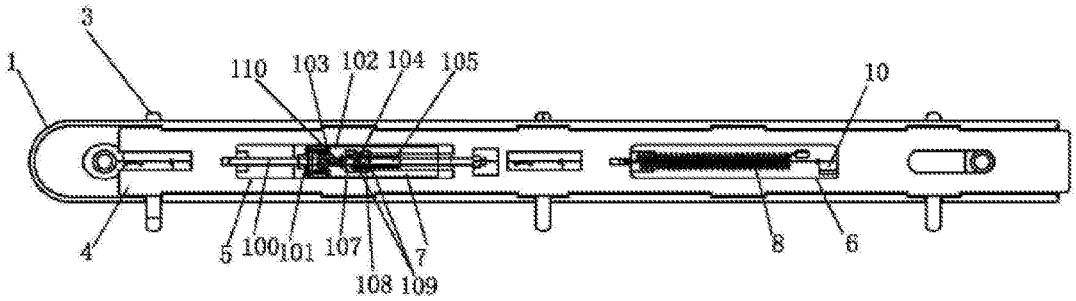
FIG. 2 This upward view invention of the Automatic cycle clip
Figure 3:
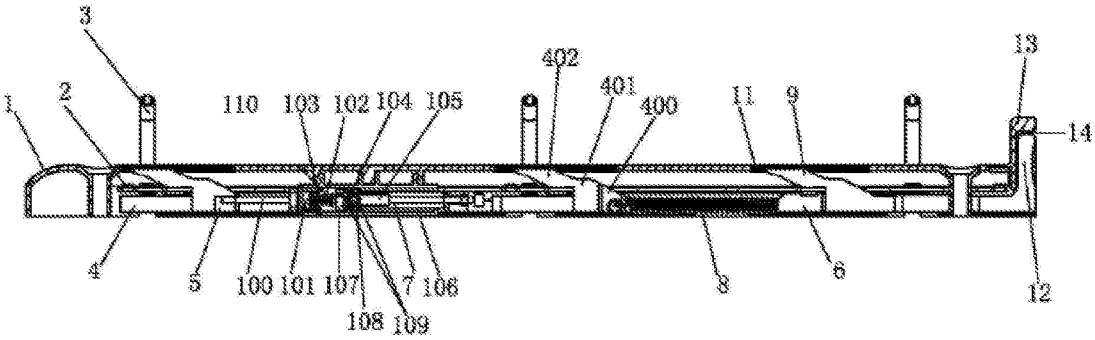
FIG. 3 This cutaway view invention of the Automatic cycle clip

Refer to FIG. 1, FIG. 2 and FIG. 3, the invention reveals the automatic cycle of clip. It includes shell 1, a pair of pivotal hinged plate 2 clamped within shell 1, and multiple pairs of half ring parts 3 which stick out from the shell 1. The parts 3 are three pairs, 3 each half ring components are composed of intermeshing round looped link 700 and oblique looped link 701. Round looped link 700 is beneficial to turn around paper and oblique ring 701 for fixation to collect paper. The automatic cycle clip also includes a handspike 4 located in the shell 1, moving along the shell 1 axis direction. The concrete is a track extended inward on both sides of shell bottom respectively, the push rod 4 move axial direction along the shell inside the orbit, shifting easily, at the bottom of hinged plate. The push rod 4 from left to right along the axis of the shell 1, has the second slot 6 and the first slots 5 in which with an automatically rotated positioning sleeve of push rod 7 to have the effect of positioning lock for push rod 4. The automatically rotated positioning sleeve of push rod 7 fixed connection with shell 1 inner surface, the driving spring 8 set into the second slot 6, to drive pull rod 4 back in the shell 1; the junction place of driving spring 8 and hinged plate 2 gets close to the right end of second slot 6, the top of push rod 4 has multi-peak bar 9 under half ring element 3 with logarithm same as the element 3. Superior to the top of the hinged plate 2 and top bar 9 corresponding location are the crossed slot 10 by top bar 9. The upper part of top bar 9 successively have AIO open clamp screw surface 400, clip the cartridge surface 401 and the clip helical surface 402 matching with clamp slot 11 at front end within shell 1, and at the right end of pushrod) 4 also has handle 12, which at the right end of shell 1 and with hands position for convenience of hand push for push rod 4, the right end face of shell 1 extended upward a damper 13, which with joystick grooves 14 corresponding 12 for expedience and practical.

Figure 6:
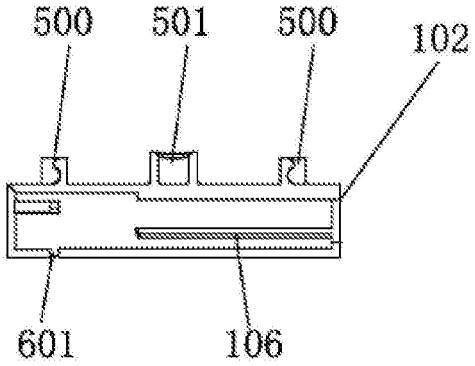
Figure 7:
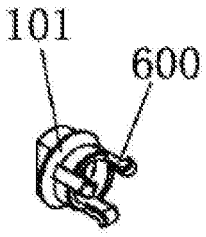

Furthermore, the automatic rotary pushrod locating sleeve 7 includes the joint lever 100, the cap 101, the support sleeve 102, the compression spring 103 in the support sleeve 102, the swivel plate sleeve 104 and the slide claw sleeve 105. The left end of the joint lever 100 is linked with the left end of first groove 5 and the right end of joint lever 100 is linked with the right end of the first groove 5. It is shown in FIG. 6. On the upper part of the support sleeve 102, there is a clamping base 500 equipped on the left and right side respectively. In the middle part of the upper support sleeve, a clamping column is equipped. On the internal surface of shell 1 are joint base and joint pins which are linked to clamping base 500 and clamping column 501 via snap joints separately. It facilitates the installation and can be linked fast. This will prevent the support sleeve 102 from moving with the joint lever 100. The left end of the support sleeve 102 and the cap 101 is fixedly linked. To be specific, the right ends of the cap 101 stretches into the support sleeve 102. See FIG. 7 for reference. On the right end surface of the cap 101, three hangers 600 are evenly equipped in the circumferential direction. In the corresponding positions on the support sleeve 102 there are peg holes 601 matching the hangers 600. The hangers 600 are buckled in the peg holes 601 and linked fast, which prevents the cap 101 from moving with the joint lever 100. On the right-hand internal surface of support sleeve 102, three convex columns 106 are evenly distributed and are axially parallel to the support sleeve 102. The right end of the swivel plate sleeve stretches into the slide claw sleeve 105 and the right end of the slide claw sleeve 105 is close to the right end of the first groove 5. On the left ends of the swivel plate sleeve 104 and the slide claw sleeve 105 are equipped with swivel plate 107 and slide claw 108 respectively. On the peripheral surface of swivel plate 107 and slide claw 108, there are grooves 109 corresponding to the convex columns 106. The swivel plate sleeve 104 and the slide claw sleeve 105 can move in the support sleeve 102 along the convex columns 106 via the grooves 109. The slide claw sleeve 105 can drive the swivel plate sleeve 104 to move and rotate. On the joint lever 100, there is a link block 110. The link block 110 is close to the left end of the swivel plate sleeve and used to prevent the moving of the swivel plate sleeve 104. One end of the compression spring 103 is connected to the cap 101, and the other end to the link block 110.

Figure 4:
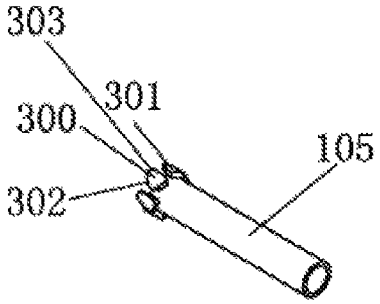
FIG. 4 This construction schematic diagram for invention of the Sliding claw sleeve FIG. 5 This construction schematic diagram for invention of the Swivel plate sleeve FIG. 6 This construction schematic diagram for invention of the Support sleeve FIG. 7 This construction schematic diagram for invention of the Block shot Diagram: 1. the shell; 2. hinged plate; 3. half ring components; 4. the push rod; 5. the first straight slot; 6. the second straight slot; 7. the automatically rotated positioning sleeve of push rod; 8. driving spring; 9. the top bar; 10. straight slot; 11. the slot; 12. handle; 13. Baffle; 14. The handle groove.
Figure 5:
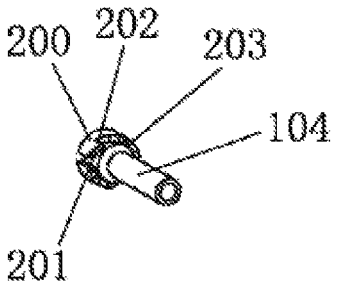

Still refer to FIG. 4 and FIG. 5. The groove 109 divides the outer circumferential surface of the swivel plate 107 into three identical convex block of swivel plate 200. The right end of the convex block of swivel plate 200 has the tilted camber surface 201, the vertical surface 202 and the inclined upright surface 203 in proper order. The tilted camber surface 201 and the inclined upright surface 203 are inclined in the same direction and the left end of convex column 106 is corresponding with the inclined upright surface 203. The groove 109 divides the outer circumferential surface of the slide claw 108 into three identical pairs of slide claw bumps. Among them, each pair of slide claws consists of the first bump 300 and the second convex block 301 and these two are identical and are placed side by side. The left ends of the first bump 300 and the second convex block 301 have the first inclined surface 302 and the second inclined surface 303. And the first inclined surface 302 is at an angle to the second inclined surface 303. The first inclined surface 302 is corresponding with the tilted camber surface 201 and the second inclined surface 303 is corresponding with the inclined upright surface 203. When the first inclined plane 302 of the first bump 300 is pushed against the tilted camber surface 201 and the second inclined plane 303 of the second convex block 301 is pushed against the inclined upright surface 203, the swivel plate sleeve 104 will move. The first bump 300 will get stuck in the groove 109 on the swivel plate 107. The left end of the convex column 106 will contact the inclined upright surface 203.

With the aforementioned the Construction, the clamping mechanism of this invention is like this. Press on the handle 12 with one hand and push the push rod 4 in the direction of the left end of the shell 1, the push rod 4 will drive the top bar 9 and the joint lever 100 to move, the recoil spring 8 will be stretched, the clamping tube surface 401, the clamping helical surface 402 and the unclamping helical surface 400 will jack up the hinged plate 2 downwards. The right end of the first groove 5 pushes the slide claw sleeve 105 to move and the slide claw sleeve 105 will drive the swivel plate sleeve 104 to do the same. The compression spring 103 will be compressed. And when the front end of the clamping helical surface 402 gets stuck in the clamping groove 11, the first inclined plane 302 of the first bump 300 will be pushed against the tilted camber surface 201 and the second inclined plane 303 of the second convex block 301 will be pushed against the inclined upright plane 203 at the same time. At this very moment, the swivel plate sleeve 104 rotates; the first bump 300 gets stuck in the groove 109 on the swivel plate 107; the left end of the convex column 106 contacts the inclined upright plane 203. Once taking back the hand, the swivel plate sleeve 104 rotates. And now the left end of the convex column 106 will be pushed against the inclined upright plane 203 and the side face of the convex column 106 is pushed against the vertical surface hanger 202. In this way the locking action is completed. The round looped link 700 and the inclined looped link 701 are intermeshed which indicates that the clamping is done. The mechanism for unclamping is like this. Press on the handle 12 with one hand and push the push rod 4 in the direction of the left end of the shell 1, the first bump 300 and the second convex block 301 push against the swivel plate bump 200. The swivel plate sleeve 104 rotates. At this very moment, the convex column 106 gets stuck in the groove 109 on the swivel plate 107. The swivel plate sleeve 104 and the slide claw sleeve 105 moves to the right end of the shell 1 along the convex column 106. Then the unclamping action is performed. Reset the compression spring 103 which will drive the push rod 4 to move to the right end of the shell 1. The push rod 4 will drive the top bar 9 to move. Then the front end of the clamping helical surface 402 will be detached from the clamping groove 11. The unclamping helical surface helical surface 400, the clamping tube plane 401 will exit from the groove 10. The recoil spring 8 is reset. The hinged plate 2 moves upwards. The round looped link 700 and the inclined looped link 701 are detached separate. Then the unclamping is done. This invention is simple in the Construction. With one hand pushing the push rod 4 circularly, it can perform the unclamping and clamping functions. It satisfies the market needs with its easy operation, convenience and lower cost.

Above mentioned invention is only for the better example, since the specific example is not limiting to the invention. Within the technology categories of the invention, can appear all sorts of deformation and modification, where the embellish, modification, or equivalent replacement made by technology personnels in this field according to the above description, all belong to the range of the invention protection.

What is claimed is:

1. An automatic loop folder, comprising a shell, a pair of pivotable hinged plates clamped by the shell, and several pairs of half-ring elements fixed on the hinged plates respectively, the half-ring elements protrude out from a shell surface, wherein the automatic loop folder also comprises a push rod located inside the shell and moveable along an axial direction of the shell, the push rod is located below the hinged plates, a first continuous slot and a second continuous slot are provided on the push rod in sequential order from a left side to a right side of the push rod along the axial direction of the shell, the first continuous slot is provided with a positioning sleeve of the push rod which is automatically rotatable, an upper end of the positioning sleeve is fixed on an inner surface of the shell, the second continuous slot is equipped with a recoil spring connecting with the hinged plates, an upper end of the push rod is provided with several mandrils, third continuous slots are provided at corresponding positions on the hinged plates, the mandrils pass through the third continuous slots; a neck which matches with front ends of the mandrils is provided on the inner surface of the shell.

2. The automatic loop folder according to claim 1, wherein the positioning sleeve comprises a connecting rod, a cap that sleeves the connecting rod, a supporting drivepipe, and a compression spring in the supporting drivepipe, a turnplate sleeve and a slide pawl sleeve, a left end of the connecting rod is connected to a left end of the first continuous slot, a right end of the connecting rod is connected to a right end of the first continuous slot, an upper end of the supporting drivepipe is fixed on the inner surface of the shell, a left end of the supporting drivepipe is connected to the cap, three embossments are provided on an inner surface of a right end of the supporting drivepipe, the three embossments are parallel to the supporting drivepipe and are uniformly distributed, a right end of the turnplate sleeve protrudes into the slide pawl sleeve, a right end of the slide pawl sleeve is positioned proximal to the right end of the first continuous slot, a left end of the turnplate sleeve and a left end of the slide pawl sleeve are provided with turnplates and slide pawls respectively, grooves corresponding to the embossments are provided on both outer circumferential surfaces of each of the turnplates and the slide pawls, the turnplate sleeve and the slide pawl sleeve are moveable inside the supporting drivepipe along the embossments via the grooves, the slide pawl sleeve drives the turnplate sleeve to move and rotate, the connecting rod is also provided with a connection block positioned proximal to the left end of the turnplate sleeve, one end of the compression spring is connected with the cap while another end of the compression spring is connected with the connection block.

3. The automatic loop folder according to claim 2, wherein the grooves divide the outer circumferential surface of each turnplate into 3 turnplate embossments which are same in size, a right end of each turnplate has an inclined arc, a vertical plane and an inclined face in sequential order, the inclined arc and the inclined face are inclined towards a same direction, the grooves divide the outer circumferential surface of each slide pawl into 3 pairs of slide pawl embossments of the same size, wherein each pair of the slide pawl embossments comprises a first embossment and a second embossment separated from each other, the first embossment and the second embossment are same in size and are arranged side by side, each of a left side of the first embossment and a left side of the second embossment has a first inclined surface and a second inclined surface, the first inclined surface corresponds to the inclined arc, the second inclined surface corresponds to the inclined face, when the first inclined surface of the first embossment presses against the inclined arc and the second inclined surface of the inclined embossment presses against the inclined face, the turnplate sleeve rotates, the first embossment enters the corresponding groove of the turnplate, and a left side of a corresponding embossment contacts a corresponding inclined face.

4. The automatic loop folder according to claim 2, wherein both left and right sides of an upper end of the supporting drivepipe are respectively equipped with a holder, a middle part of the upper end of the supporting drivepipe is provided with a column, corresponding positions of the inner surface of the shell are provided with connection base and connection column that respectively connect with the buckles of the holder and the column.

5. The automatic loop folder according to claim 2, wherein a right end of the cap stretches into the support drivepipe, a surface of the right end of the cap is circumferentially and evenly provided with three hooks; holes corresponding to the hooks are provided on corresponding positions of the supporting drivepipe; the hooks are buckled in the holes.

6. The automatic loop folder according to claim 1, wherein each mandril is equipped with an integrally formed folder-open spiral surface, a folder-close cylindrical surface and a folder-close spiral surface, a front end of the folder-close spiral surface matches with the neck.

7. The automatic loop folder according to claim 1, wherein a right end of the push rod is provided with a handle located at a right end of the shell.

8. The automatic loop folder according to claim 7, wherein a surface of the right end of the shell has a baffle extending upward; the baffle is provided with a handle groove corresponding to the handle.

9. The automatic loop folder according to claim 1, wherein each pair of the half-ring elements comprises a round hook ring and an oblique hook ring; the round hook ring and the oblique hook ring are engageable with each other.

* * * * *